US007182507B2

(12) United States Patent
Hiranuma et al.

(10) Patent No.: US 7,182,507 B2
(45) Date of Patent: Feb. 27, 2007

(54) PORTABLE TIMEPIECE

(75) Inventors: Haruki Hiranuma, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/332,560

(22) Filed: Jan. 13, 2006

(65) Prior Publication Data

US 2006/0158967 A1 Jul. 20, 2006

(30) Foreign Application Priority Data

Jan. 17, 2005 (JP) ..... 2005-009391

(51) Int. Cl.
*G04B 29/00* (2006.01)
*G04B 37/00* (2006.01)

(52) U.S. Cl. ..... 368/289; 368/308; 368/319

(58) Field of Classification Search ..... None
See application file for complete search history.

(56) References Cited

U.S. PATENT DOCUMENTS

| | | | | |
|---|---|---|---|---|
| 2,399,092 | A * | 4/1946 | Bolle | 368/288 |
| 5,383,166 | A * | 1/1995 | Gallay | 368/288 |
| 6,886,975 | B2 * | 5/2005 | Hiranuma et al. | 368/289 |
| 7,025,494 | B2 * | 4/2006 | Oomori et al. | 368/190 |
| 7,111,977 | B2 * | 9/2006 | Hiranuma et al. | 368/289 |
| 2004/0071049 | A1 | 4/2004 | Hiranuma et al. | |
| 2005/0088920 | A1 * | 4/2005 | Hiranuma et al. | 368/319 |
| 2005/0094498 | A1 * | 5/2005 | Koshoji et al. | 368/319 |

FOREIGN PATENT DOCUMENTS

| | | |
|---|---|---|
| EP | 1 124 167 A1 | 8/2001 |
| EP | 1 205 826 A1 | 5/2002 |

* cited by examiner

*Primary Examiner*—Vit Miska
(74) *Attorney, Agent, or Firm*—Adams & Wilks

(57) ABSTRACT

To provide a portable timepiece capable of interchanging a part at a surrounding of a crown when a screw lock function is deteriorated. A premise is established by a portable timepiece screwing to lock a crown urged in a direction of separating from a case body by a coil spring (urging member) included in a winding stem pipe to the winding stem pipe attached to the case body. The winding stem pipe includes a winding stem pipe main body inserted into a pipe attaching hole of the case body and fixed in liquid tight by using a brazing member, and a ring fitted to a case body outside projected portion of the main body removably by being stopped to rotate and provided with a male screw portion to which the crown is removably screwed at an outer periphery thereof. A ring holding member is pinched between the ring and a holding portion of the case body outside projected portion. The ring holding member holds the ring at an outer periphery of the case body outside projected portion and releases the ring from being held thereby when an external force sufficient for releasing the holding state is exerted to the ring.

7 Claims, 11 Drawing Sheets

PORTABLE TIMEPIECE

BACKGROUND OF THE INVENTION

1. Field of the Invention

The present invention relates to a portable timepiece having a structure of holding a crown so as not to be rotated unpreparedly.

2. Description of the Prior Art

There is a portable timepiece adopting a structure of locking a crown by utilizing mesh of screws (the structure is referred to as screw lock in the specification) such that the crown is not rotated unpreparedly in carrying the portable timepiece.

The screw lock structure is constituted by a structure of attaching a winding stem pipe to a case body including a timepiece movement and screwing a female screw portion of a main body portion of the crown fitted to a case back outside projected portion to a male screw portion formed at an outer periphery of the case back outside projected portion of the pipe. Thereby, normally, the crown can be locked by screwing the main body portion of the crown to the outer periphery of the case back out side projected portion. Further, in operating the timepiece movement, a winding stem arranged on an inner side of the winding stem pipe can be operated to rotate in a state of pulling to move the crown after disengaging the main body portion of the crown from being screwed to the male screw portion.

According to the portable timepiece of the background art having such a screw lock structure, generally, by brazing the winding stem pipe to the case back, waterproof of a portion of attaching the winding stem pipe is achieved (refer to, for example, JP-A-57-46181).

Otherwise, there is also known a portable timepiece in which a winding stem pipe is provided with a male screw portion separately from a male screw portion screwed with a crown, the separately provided male screw portion is screwed to a pipe attaching hole of a case back, and in accordance with the screwing operation, a waterproof packing is pinched between the case back and the winding stem pipe to thereby achieve waterproof of a portion of attaching the winding stem pipe (refer to, for example, JP-A-2004-245594).

According to the portable timepiece having the screw lock structure, there is a case in which in accordance with operating to rotate the crown repeatedly, the female screw portion of the crown and the male screw portion of the winding stem pipe screwed to each other are worn or ground. Thereby, a function of screw lock is deteriorated.

When such a situation is brought about, in the case of the portable timepiece of JP-A-57-46181 in which the winding stem pipe is brazed to the case back, interchange of a part around the crown in accordance with removing the winding stem pipe from the case back cannot be carried out. Therefore, a timepiece exterior assembly including the case back is obliged to be interchanged and an improvement thereof is requested.

It is conceived that according to the timepiece in which the winding stem pipe is screwed to the case back, in principle, a part at a surrounding of the crown including the winding stem pipe can be interchanged. However, also in the constitution, at each time of screwing the crown to the winding stem pipe or disengaging the crown from being engaged in this way, the winding stem pipe is operated with rotational force. In accordance therewith, there is a concern of deteriorating waterproof performance by the waterproof packing by loosening the winding stem pipe from being screwed to the case back.

As a countermeasure therefor, there is a case of filling an adhering agent to portions of the winding stem pipe and the case back screwed to each other. When the winding stem pipe and the case back are adhered in this way, it is difficult to remove the winding stem pipe from the case back and actually, a part at a surrounding the crown cannot be interchanged. Thereby, when the screw lock function is deteriorated, a timepiece exterior assembly including the case body is obliged to be interchanged and therefore, an improvement thereof is requested.

SUMMARY OF THE INVENTION

It is an object of the invention to provide a portable timepiece capable of interchanging a part at a surrounding of a crown when a screw lock function is deteriorated.

In order to resolve the above-described problem, according to the invention, there is provided a portable timepiece comprising a case body having a pipe attaching hole; a winding stem pipe arranged at an outer portion of the case body, having a case body outside projected portion formed with a holding portion and a rotation stop portion, inserted into the pipe attaching hole and fixed to the case body in liquid tight; a ring having a male screw portion formed at an outer periphery thereof and a rotation stop hole fitted to the rotation stop portion and fitted attachably and detachably to and from the case body outside projected portion; a crown removably screwed to the male screw portion; an urging member included in the winding stem pipe for urging the crown in a direction of being separated from the case body; and a ring holding member pinched between the holding portion and the ring for holding the ring and capable of releasing the ring from being held when an external force sufficient for releasing the holding state is exerted to the ring.

According to the invention, the winding stem pipe main body is fixed to the case body in liquid tight and unseparably. Further, according to the ring to which the crown is attachably and detachably screwed and which screws to lock the crown by screwing the crown, the ring can be removed from the case body outside projected portion by manually releasing the holding state of the ring by the ring holding member for holding the ring to the case body outside projected portion of the winding stem pipe main body against an urge force of the urging member. Therefore, when a screw lock function is deteriorated in accordance with operation of rotating the crown for achieving or releasing the screw lock function, at least the ring by itself in the crown and the ring can be interchanged by making the winding stem pipe main body stay to be fixed to the case body in liquid tight.

According to a preferable embodiment of the invention, the ring holding member is pinched between the holding portion and the ring in a compressed state as an elastic material. According to the preferable embodiment, the ring can easily be attached and detached to and from the ring holding member by utilizing the elastic deformation of the ring holding member and in normally using the portable timepiece, the ring can firmly be held against the urge force of the urging member by an elastic repulsion force of the ring holding member.

Further, according to a preferable embodiment of the invention, the case body outside projected portion is provided with a stepped portion for engaging with an edge of the ring holding member on a side of being remote from the case body from a side opposed to an urging direction of the urging member. According to the preferable embodiment, the ring can firmly be held against the urge force of the urging member by catching the ring holding member by the stepped portion.

Further, according to a preferable embodiment of the invention, an inner periphery of the ring is provided with an engaging groove fitted to an outer peripheral portion of the ring holding member and a depth of fitting the rotation stop hole to the rotation stop portion is made to be larger than a distance between an edge of the fitting groove arranged at a position the same as a position of the stepped portion in an axial direction of the case body outside projected portion on a side of being remote from the case body and the case body. According to the preferable embodiment, in fitting to attach the ring to the case body outside projected portion, before properly fitting the fitting groove of the ring to the outer peripheral portion of the ring holding member previously attached to an outer periphery of the holding portion, an edge of the rotation stop hole of the ring is not butted to a stepped portion constituting a boundary between the holding portion and the rotation stop portion. Therefore, the ring holding member can properly be pinched between the ring and the holding portion and by properly fitting the fitting groove of the ring to the outer peripheral portion of the ring holding member, the ring can firmly be held against the urge force of the urging member.

Further, according to a preferable embodiment of the invention, an engaging portion is provided at an end portion of the ring on a side of being proximate to the case body and the engaging portion is caught by an edge of the ring holding member on a side of being proximate to the case body. According to the preferable embodiment, the ring can firmly be held against the urge force of the urging member by catching the engaging portion by the edge of the ring holding member on the side of being proximate to the case body.

Further, according to a preferable embodiment of the invention, the ring holding member is formed by a ring-like portion pinched between the holding portion and the ring and a flange portion pinched between an end portion of the crown on a side of being proximate to the case body and the case body. According to the preferable embodiment, in accordance with a fastening operation for screwing to lock the crown, the end portion of the crown on the side of being proximate to the case body can be prevented from biting the outer face of the case body by the flange portion and therefore, in starting to rotate the crown for releasing the crown from being screwed to lock, an excessively large rotational force is not needed and an operational feeling can be improved.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A first embodiment of the invention will be explained in reference to FIG. 1 through FIG. 6.

Figure 1:
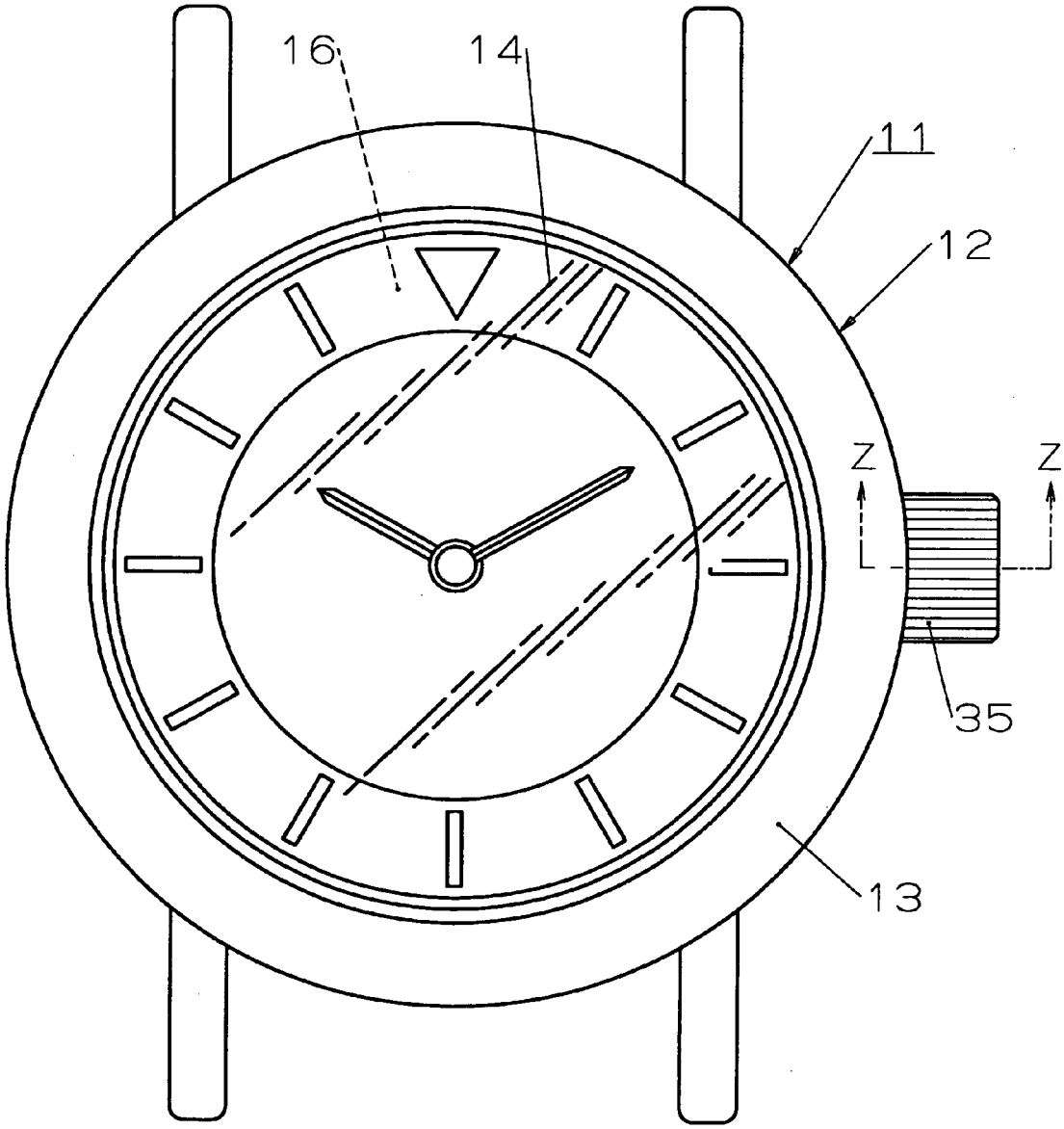
FIG. 1 is a front view showing a wristwatch according to a first embodiment of the invention.

In FIG. 1, notation 11 designates, for example, a wristwatch of a portable timepiece having a function capable of screwing to lock a crown. The wristwatch 11 contains a timepiece movement or the like, not illustrated, at inside of a timepiece exterior assembly 12. The timepiece movement may be any of those constituting power by a small-sized battery or a mainspring, of automatic winding, or in correspondence with a digital timepiece for displaying time or the like in digital on a dial by a quartz oscillation module, or using both of a constitution in correspondence with a digital timepiece and other constitution or the like.

The timepiece exterior assembly 12 is formed by mounting in liquid tight cover glass 14 to one face in a thickness direction of a case body 13 made of a metal constituting a ring-like shape and mounting in liquid tight a case back 15 (refer to FIG. 2 and FIG. 3) comprising a metal or the like to a rear face in the thickness direction of the case body 13. A dial 16 or the like can be seen through the cover glass 14 and the case back 15 can be removed.

Figure 2:
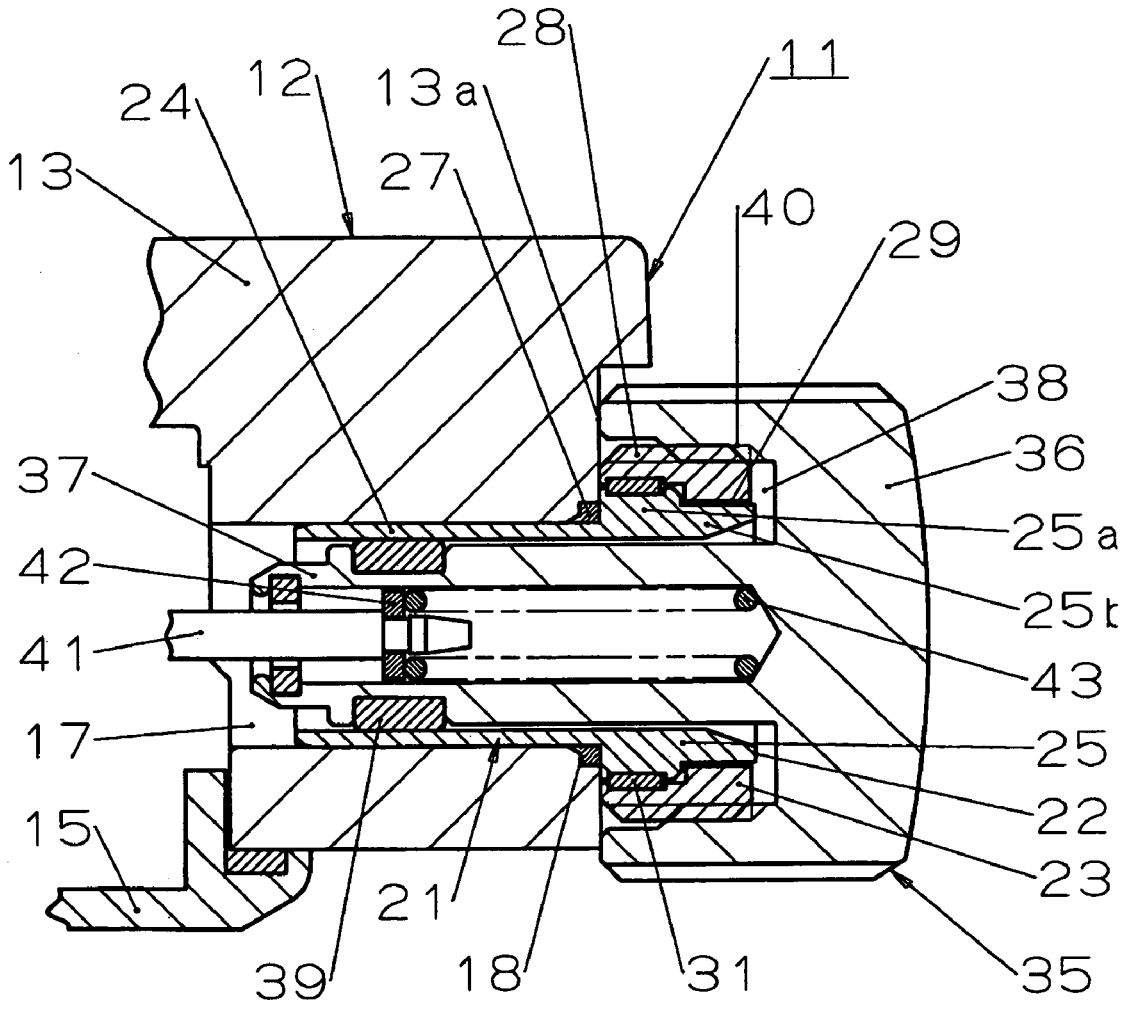
FIG. 2 is a sectional view taken along a line Z—Z of FIG. 1 showing a state of screwing to lock a crown.
Figure 3:
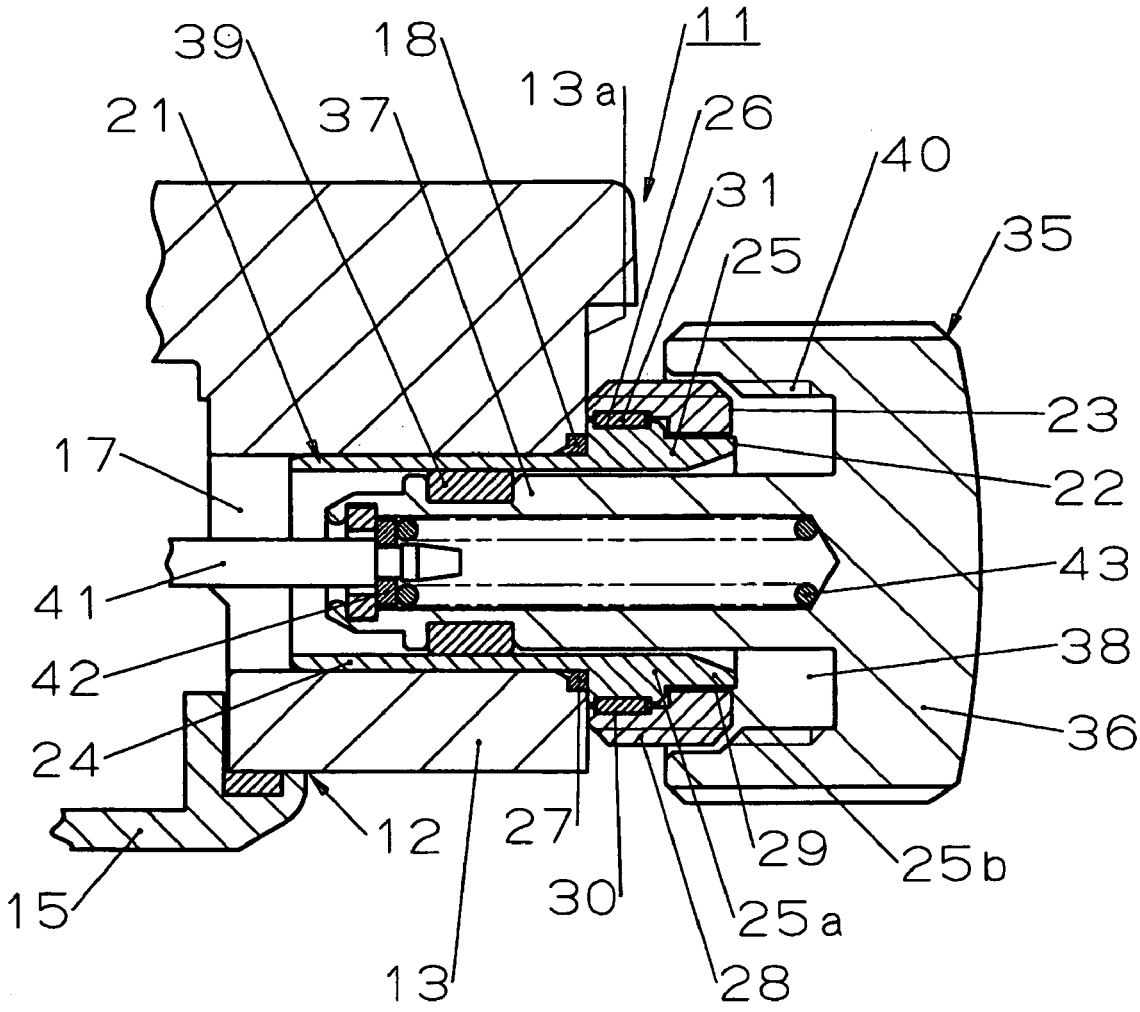
FIG. 3 is a sectional view taken along the line Z—Z of FIG. 1 showing a state of releasing the crown from being screwed to lock.
Figure 4:
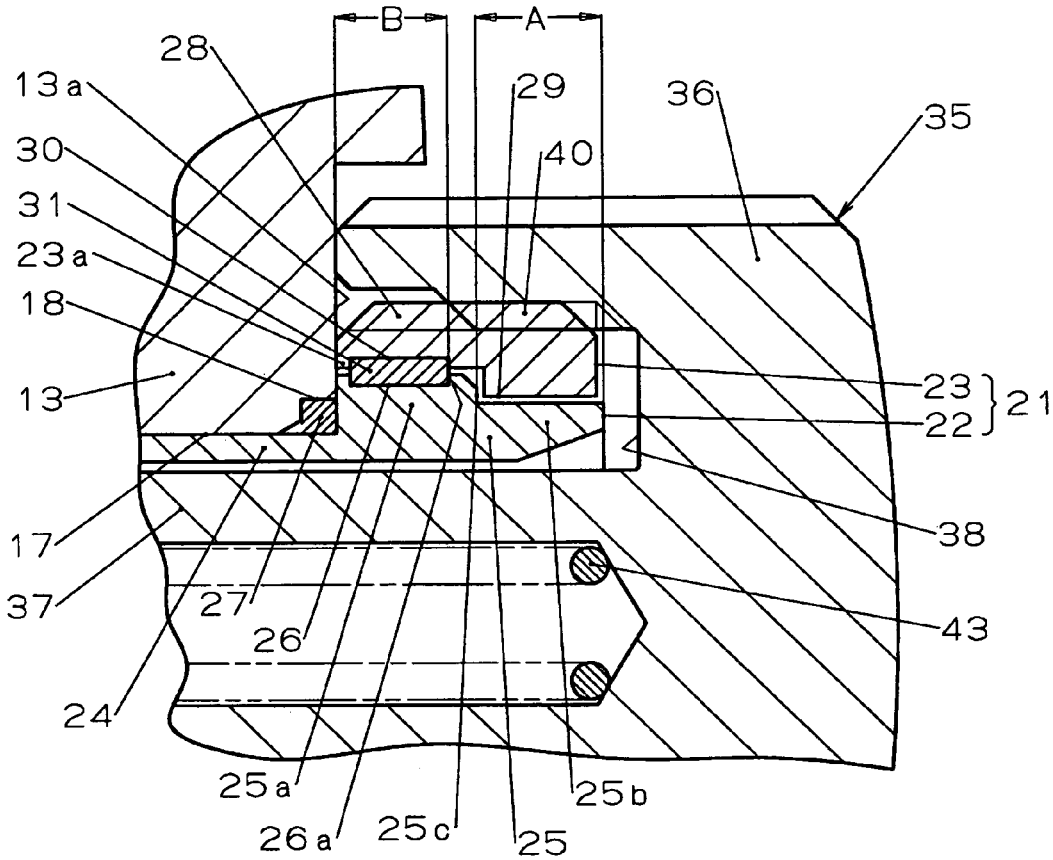
FIG. 4 is a sectional view enlarging to show a state of screwing to lock a crown of the wristwatch according to the first embodiment.

As shown by FIG. 2 through FIG. 4, a portion of the case back 13 is provided with a pipe attaching hole 17 penetrating the case body 13 in a diameter direction. One end of the pipe attaching hole 17 is opened to inside of the case body, that is, an inner portion of the timepiece exterior assembly 12 and the other end of the pipe attaching hole 17 is opened to outside of the case body, that is, to an outer portion of the timepiece exterior assembly 12. A ring-like groove 18 is formed at a case body outer face 13*a* of the case body 13. The ring-like groove 18 is provided with a diameter larger than that of the pipe attaching hole 17, communicated with a case body outer side opening of the hole 17 and is provided concentrically with the opening.

Figure 5:
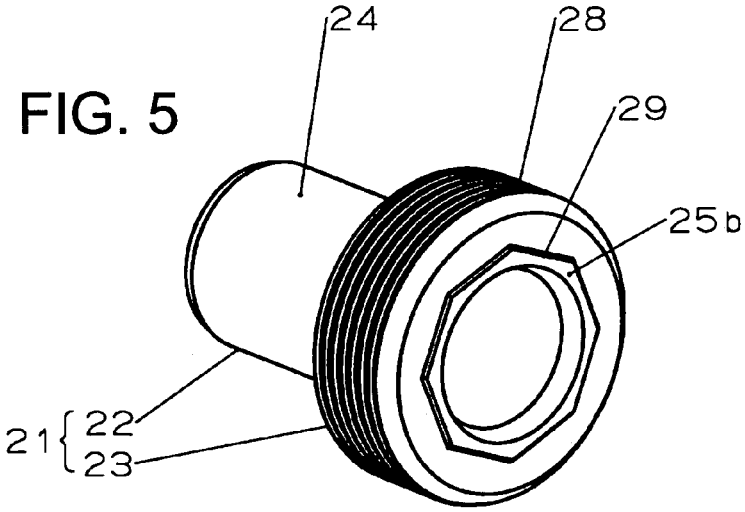
FIG. 5 is a perspective view showing a winding stem pipe provided to the wristwatch according to the first embodiment.

The case body 13 is fixed in liquid tight with a winding stem pipe 21 inserted to the pipe attaching hole 17 from a case body outer side. As shown by FIG. 5 and the like, the winding stem pipe 21 is formed by a winding stem pipe main body 22 and a ring 23 fitted thereto attachably and detachably. A state of fitting the ring 23 functioning as a dummy member is held by a ring holding member 31, mentioned later.

Figure 6:
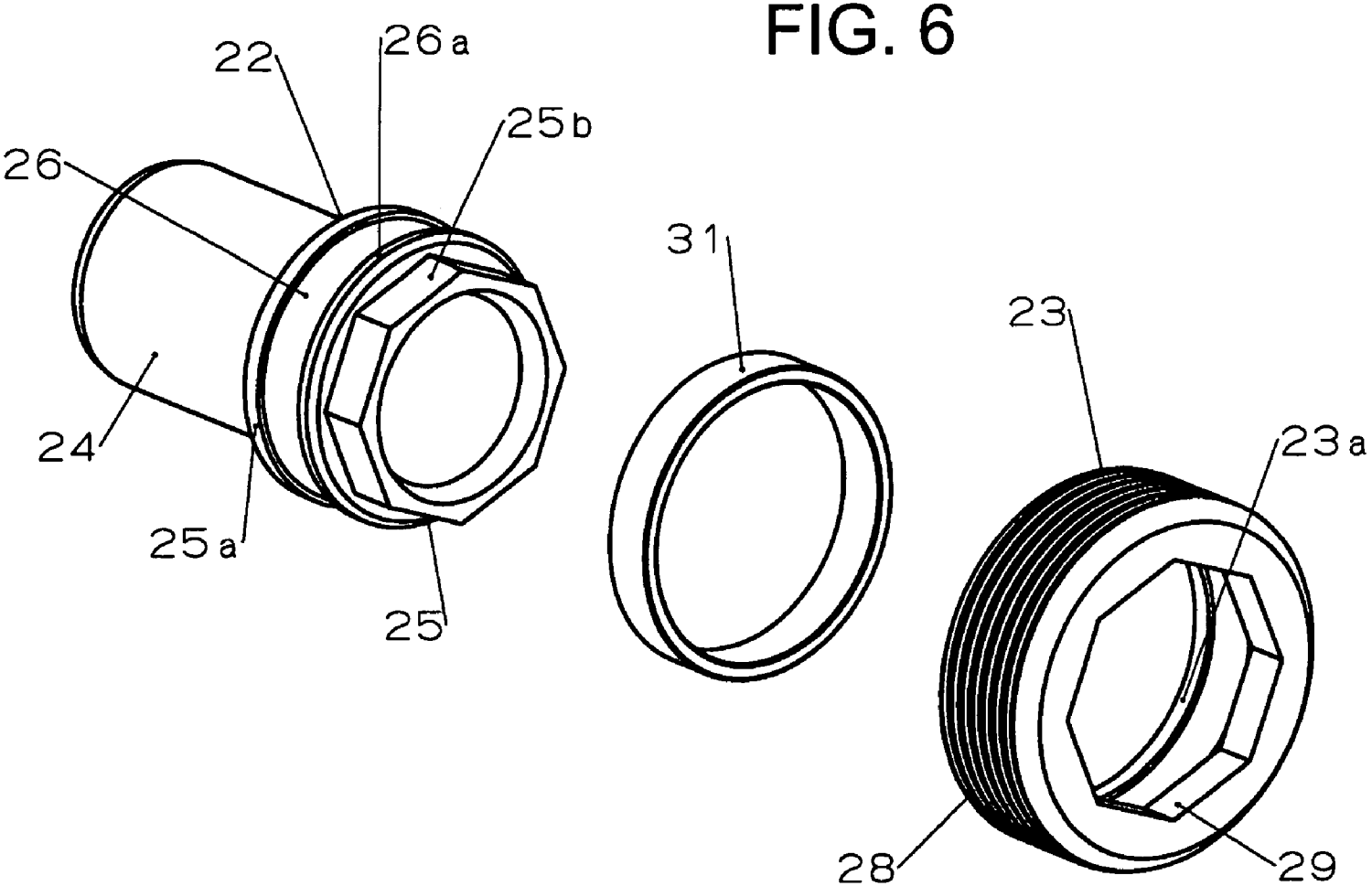
FIG. 6 is a perspective view disassembling to show the winding stem pipe of FIG. 5.

In details, the winding stem pipe main body 22 is made of a metal, for example, stainless steel can preferably be used therefor. As shown by FIG. 6 and the like, the winding stem pipe main body 22 includes an inserting portion 24 on one end side thereof and a case body outside butting portion 25 on the other end side. The inserting portion 24 is a portion inserted from the case body outer side to the pipe attaching hole 17, for example, in a press fit state. The case body outside projected portion 25 is a portion arranged at outside of the case back 13 and includes a holding portion 25*a* and a rotation stop portion 25*b*. Outer diameters of the holding portion 25*a* and the rotation stop portion 25*b* are larger than an outer diameter of the inserting portion 24 and a diameter of the ring-like groove 18.

A fitting groove 26 is formed at an outer periphery of the holding portion 25*a* integrally continuous to the inserting portion 24 by constituting a stepped difference therebetween. The fitting groove 26 is provided continuously in a peripheral direction of the inserting portion 24 and is formed with a stepped portion 26*a* (refer to FIG. 4) by an edge thereof remote from the inserting portion 24, in other words, by an edge thereof on a side of being remote from the case body outer face 13*a* in a state in which the winding stem pipe main body 22 is attached to the case body 13 as mentioned later. The stepped portion 26*a* is continuous in a peripheral direction of the inserting portion 24.

The rotation stop portion 25*b* is disposed on a side opposed to the inserting portion 24 by constituting a reference by the holding portion 25*a*. An outer periphery of the rotation stop portion 25*b* is formed in a noncircular shape, for example, a polygonal shape, specifically, a regular octagonal shape as shown by FIG. 5 and FIG. 6. An outer diameter of the rotation stop portion 25*b* capable of being drawn by passing respective corners of the rotation stop portion 25*b* is smaller than an outer diameter of the holding portion 25*a*.

The ring 23 is made of a metal, for example, stainless steel can preferably be used therefor. The ring 23 includes a male screw portion 28 and a rotation stop hole 29 as shown by FIG. 6 and the like. The ring 23 is provided with a length substantially the same as that of the case body outside projected portion 25 and an outer periphery thereof is formed with the male screw portion 28 for screw lock. The rotation stop hole 29 provided to be disposed at one end portion of the ring 23 is constituted by a noncircular hole, for example, a polygonal hole in a regular octagonal shape in correspondence with the shape of the rotation stop portion 25*b*. As shown by FIG. 4 and the like, an inner periphery of the ring 13 is formed with a fitting groove 30 at a position in correspondence with the fitting groove 26 to be shifted from the rotation stop hole 29. The rotation stop hole 29 is fitted to an outer periphery of the rotation stop portion 25*b* and by fitting the rotation stop hole 29 and the outer periphery of the rotation stop portion 25*b*, the ring 23 is stopped to rotate in the peripheral direction relative to the case body outside projected portion 25 in operating a crown. As described above, the rotation stop portion 25*b* and the rotation stop hole 29 fitted to each other in the noncircular shape constitute rotation stop means of the ring 23, the embodiment is not restricted thereto but the rotation stop means can be constituted by including, for example, one or more of keys extended in an axial direction of the pipe and a key groove(s) slidably fitted thereto, or can be constituted by fitting using serrations or the like.

The ring 23 includes an engaging portion 23*a*. The engaging portion 23*a* is formed at an end portion of the ring 23 on a side of being proximate to the case body 13, that is, an end portion thereof being brought into contact with or proximate to the case body outer face 13*a* in a state of attaching the winding stem pipe 21 to the case body 13. The engaging portion 23*a* constitutes an edge of the fitting groove 30 on a side of being proximate to the case body. Further, as shown by FIG. 4, it is preferable to provide an inner periphery of the engaging portion 23*a* with a taper of enlarging a hole diameter as being proximate to the case body outer face 13*a*.

The ring holding member 31 is made of a deformable material, preferably, an elastic material capable of being deformed elastically, for example, plastic having an elasticity and is formed in a ring-like shape. Here, the ring-like shape includes a ring-like shape exemplified in FIG. 6, and a shape which can be substantially regarded as a ring-like shape although a portion thereof in a peripheral direction includes a separating portion making the ring discontinuous. Although a width of the ring holding member 31 is the same as widths of the fitting grooves 26, 30, a thickness of the ring holding member 31 is larger than depths of the fitting grooves 26, 30. The ring holding member 31 is attached to an outer periphery of the case body outside projected portion 25 by being fitted to the fitting groove 26.

The ring holding member 31 is interposed between the holding portion 25*a* and the ring 23 by constituting a compressed state and is fitted to fitting grooves 26, 30. The ring 23 is held by the case body outside projected portion 25 by a friction force between the ring holding member 31 and the holding portion 25*a* and the ring 23 thereby. Further, in a state of an edge of the ring holding member 31 remote from the case body 13 is caught by a stepped portion 26*a* and an edge of the ring holding member 31 proximate to the case body 13 is caught by the engaging portion 23*a*. Thereby, the ring holding member 31 and the ring 23 are further prevented from being deviated in a direction of separating from the case body 13 along the axial direction of the case body outside projected portion 25.

The ring 23 is attached to the case body outside projected portion 25 of the winding stem pipe main body 22 fixed to the case body 13 by the following procedure. First, the ring holding member 31 is fitted to the fitting groove 26 of the case body outside projected portion 25. Next, the ring 23 is fitted to the case body outside projected portion 25 while matching the polygonal shapes of the rotation stop hole 29 of the ring 23 and the rotation stop portion 25*b*. Thereby, the ring holding member 31 is elastically deformed in a compressed state, interposed between the ring 23 and the holding portion 25*a* of the case body outside projected portion 25 and the rotation stop hole 29 is fitted to the rotation stop portion 25*b*. In this case, simultaneously with passing the engaging portion 23*a* passing in a width direction of the ring 23 while elastically deforming an outer peripheral portion of the ring 23 through the ring 23, the engaging groove 30 of the ring 23 is fitted to the outer peripheral portion of the ring 23, further, the engaging portion 23*a* is caught by an edge of the ring holding member 31 proximate to the case body 13 and is brought into contact with or proximate to the case body outer face 13*a*.

In this case, as shown by FIG. 4, a depth A of fitting the rotation stop hole 29 to the rotation stop portion 25*b* is set to be larger than a distance B between an edge of the fitting groove 30 arranged at a position the same as that of the stepped portion 26*a* in the axial direction of the case body outside projected portion 25 on a side remote from the case body outer face 13*a* and the case body outer face 13*a*. Thereby, when the ring 23 is fitted to the case body outside projected portion 25 as described above, an edge of the rotation stop hole 29 of the ring 23 is not butted to a stepped portion 25*c* constituting a boundary between the holding portion 25*a* and the rotation stop portion 25*b* before the fitting groove 30 of the ring 23 is, properly fitted to the outer peripheral portion of the ring holding member 31 attached to the outer periphery of the holding portion 25*a*. Therefore, the ring holding member 31 can properly be pinched between the ring 23 and the holding portion 25*a* and by properly fitting the fitting groove 30 of the ring 23 to the outer peripheral portion of the ring holding member 31, the ring 23 can firmly be held by an outer face of the case body outside projected portion 25 against an urge force of a coil spring 43, mentioned later.

According to the winding stem pipe 21 having the above-described constitution, the case body outside projected portion 25 of the winding stem pipe main body 22 is inserted into the pipe attaching hole 17 to be butted to the case body outer face 13*a* and is fixed unseparably to the case body 13 by a brazing member 27 (refer to FIG. 2 through FIG. 4) made of a metal held in the ring-like groove 18. The brazing member 27 for fixing the case body outside projected portion 25 functions also as a member for holding in liquid tight to waterproof an interval between the case body 13 and the winding stem pipe main body 22. Further, although according to the embodiment, the inserting portion 24 is provided with a length which does not penetrate through the pipe attaching hole 17, the length may be constituted by a length for penetrating through the pipe attaching hole 17. Further, in place of the brazing, the inserting portion 24 may be screwed to the pipe attaching hole 17 by interposing a waterproof packing made of rubber between the case body 13 and the winding stem pipe main body 22 to fix in liquid tight and the pipe attaching hole 17 and the inserting portion 24 may be adhered by an adhering agent.

A crown indicated by notation 35 in FIG. 1 through FIG. 4 is made of a metal and includes a crown main portion 36 and a crown cylinder portion 37 projected to a rear side integrally from the center portion thereof.

The crown main portion 36 is provided with a ring-like groove 38 for surrounding a root side portion of the crown cylinder portion 37. The crown cylinder portion 37 is inserted into an inner side of the inserting portion 24 to be extractable and retractable in the axial direction. A waterproof packing 39 constituting a ring-like shape is attached to a packing attaching groove in a ring-like shape formed at an outer periphery of the crown cylinder portion 37. The waterproof packing 39 is pinched between an inner periphery of the winding stem pipe 21 and an outer periphery of the crown cylinder portion 37 to be elastically deformed in a compressed state to waterproof therebetween.

The ring-like groove 38 is a portion for containing the case body outside projected portion 25 attached with the ring 23 and the ring-like groove 38 is formed with a female screw portion 40 for screw lock. The female screw portion 40 is removably screwed to the male screw portion 28 of the ring 23. In this case, by rotating the crown 35 in a fastening direction by putting the finger on the crown main portion 36 of the crown 35, mesh (screwing) of the female screw portion 40 to the male screw portion 28 can be deepened, conversely, by rotating the crown 35 in a loosening direction, the mesh can be disengaged. Further, by rotating to fasten the crown 35, as shown by FIG. 2, the crown main portion 36 is brought into close contact with the case body outside face 13*a* of the case body 13 to achieve a function of screwing to lock the crown 35 such that the crown 35 is not unpreparedly rotated in carrying the wristwatch 11.

As shown by FIG. 2 and FIG. 3, inside of the crown cylinder portion 37 is inserted with the winding stem 41 of the timepiece movement from inside to outside of the case body 13 and contains an urging member, for example, a coil spring 43 for urging the crown 35 to outside of the case body 13 via a spring receive 40 by being supported by the winding stem 41. The timepiece movement is rotated in cooperation with operation of rotating the crown 35 in a state of disengaging mesh of the female screw portion 40 from the male screw portion 28, in other words, in a state of releasing screw lock (refer to FIG. 3). Thereby, time is set or the like.

In order to attaching the crown 35 to the case body outside projected portion 25 to be screwed to lock after operating the crown, the crown 35 is attached thereto by screwing the female screw portion 40 of the crown main portion 36 to the male screw portion 28 of the ring 23 to fasten while pushing the crown 35 into the winding stem pipe 21 from outside of the case body 13 in a state of connecting the winding stem 41 to the crown cylinder portion 37. In a state of screwing the crown 35 to the male screw portion 28 the most deeply, the crown main portion 36 is brought into contact with the case body outer face 13*a* of the case body 13 at an end face thereof as shown by FIG. 2 and covers to conceal the ring 23 and the case body outside projected portion 25 attached therewith.

In a state of finishing to attach the crown 35, a high pressure waterproofing function can be achieved and maintained as follows. That is, waterproof between the winding stem pipe 21 and the case body 13 can be ensured by the brazing member 27 fixing the winding stem pipe 21 and the case body 13 and waterproof between the winding stem pipe 21 and the crown cylinder portion 37 inserted to an inner side thereof can be ensued by the waterproof packing 39 interposed therebetween by being elastically deformed in the compressed state.

In carrying the portable timepiece 11, the crown 35 is screwed to be locked and therefore, the crown 35 can be prevented from being rotated unpreparedly to change time display or the like. In setting time or the like, time can be set by pulling out the crown 35 against the spring force of the coil spring 43 by disengaging mesh of the crown main portion 36 from the male screw portion 28 of the ring 23 by rotating the crown 35 in a direction reverse to that in the case of screwing to lock the crown 35.

In a case of deteriorating the screw lock function of the crown 35 by damaging or wearing the screw portion in accordance with operation of rotating the crown 35, the case can be dealt with by interchanging parts as follows.

That is, first, after removing the crown 35 from the case body 13, a front end of a tool is inserted to between the case body outer face 13*a* and the end face of the ring 23 brought into contact therewith or proximate thereto, a prying force necessary sufficient for removing the ring 23 is exerted to the ring 23 to be separated from the case body outer face 13*a*, and the ring 23 is removed from the outer periphery of the case body outside projected portion 25 of the winding stem pipe 21.

The removing is carried out while maintaining a state of fixing the winding stem pipe main body 22 to the case body 13 by brazing. In this case, by the prying force, the ring holding member 31 can easily be released from being brought into close contact with the inner face of the ring 23, and the engaging portion 23*a* of the ring 23 is easily disengaged from the ring holding member 31 since a catching margin is small, further, the engaging portion 23*a* can pass the ring holding member 31 while elastically deforming mainly the outer peripheral portion of the ring holding member 31 and therefore, the ring 23 can be disengaged without requiring much labor.

Next, it is possible to attach a newly prepared ring to the case body outside projected portion 25 of the winding stem pipe main body 22 and to screw to attach the crown 35 to the ring. In this case, the crown 35 and the ring holding member 31 can be interchanged as necessary.

As described above, at least the ring by itself in a new ring and the crown and the like can be interchanged while maintaining a state of fixing the winding stem pipe main body 22 to the case body 13 by brazing with regard to a deterioration in the screw lock function. Therefore, in repairing for the deterioration in the screw lock function, the waterproof function between the case body 13 and the winding stem pipe 21 is not deteriorated and therefore, initial quality can be maintained over a long period of time, for a client of repair, it is not necessary to interchange a total of the timepiece exterior assembly 12 including the case body 13, repair can be dealt with by interchanging parts and therefore, burden of cost can be alleviated.

Further, in repair for the deterioration in the screw lock function, it is preferable to prepare a plurality of kinds of new ones of the rings 23 as interchange parts having a common shape of the ring 23 and having different diameters, pitches and numbers of threads of the male screw portions 28 and prepare a plurality of kinds of the crowns 35 having female screw portions individually in correspondence with the male screw portions 28. In this case, the ring 23 and the crown 35 can be interchanged by new ones thereof of the same kinds arbitrarily selected from the plurality of kinds without being restricted to interchanging the ring 23 and the crown 35 to be damaged and abandoned by the same ones by using them. Thereby, it is not necessary to store parts to be interchanged over a long period of time and therefore, part control is facilitated for a side of a manufacturer.

Further, the ring 23 stopped to rotate at the case body outside projected portion 25 covers the ring holding member 31. Therefore, when a user assumedly disengages the crown 35, a constitution for stopping the ring 23 in the axial direction of the case body outside projected portion 25 to be disengaged therefrom is not optically recognized, which is preferable from a view point of an excellent outlook.

Figure 7:
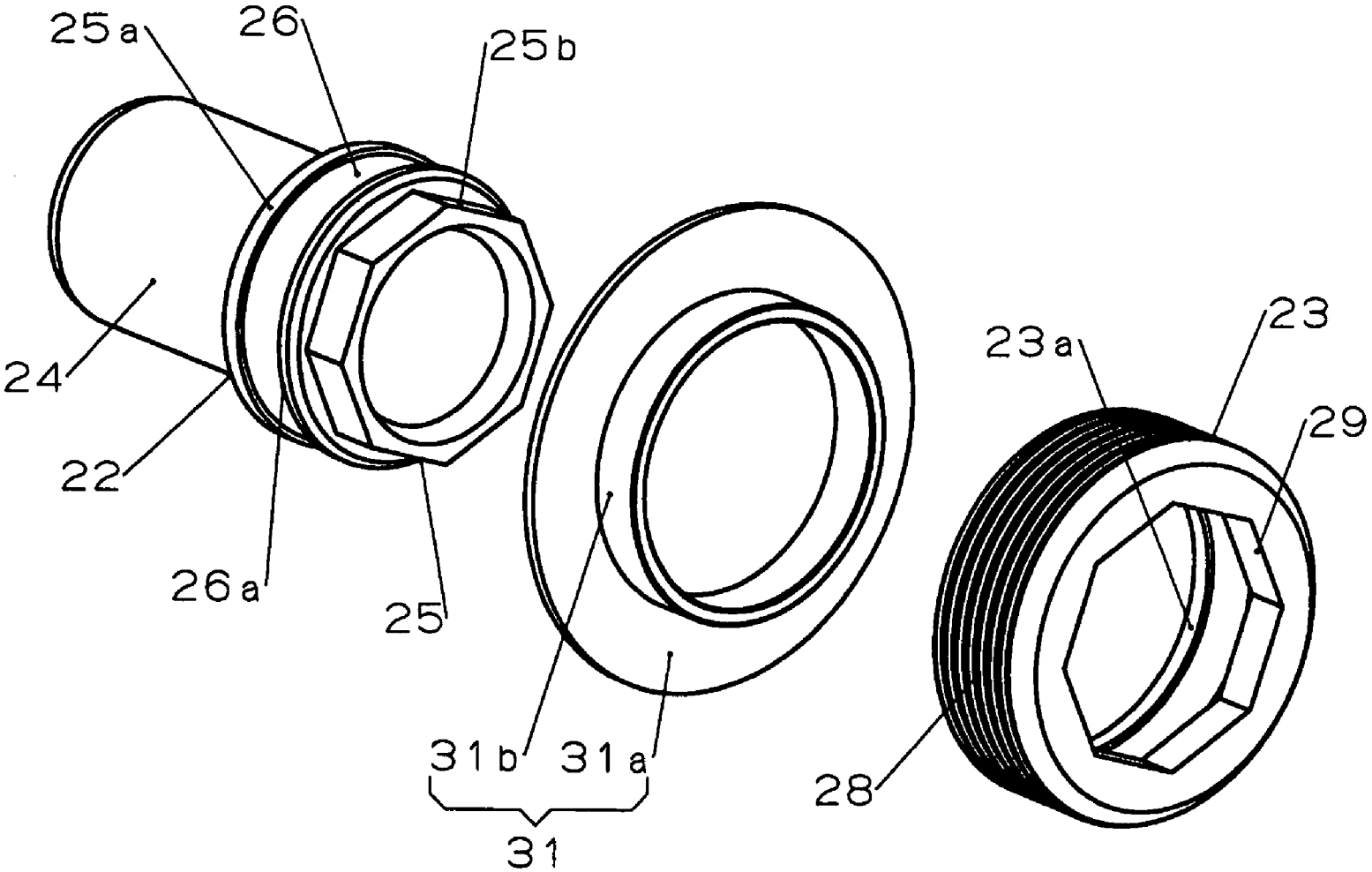
FIG. 7 is a perspective view disassembling to show a winding stem pipe provided to a wristwatch according to a second embodiment of the invention.
Figure 8:
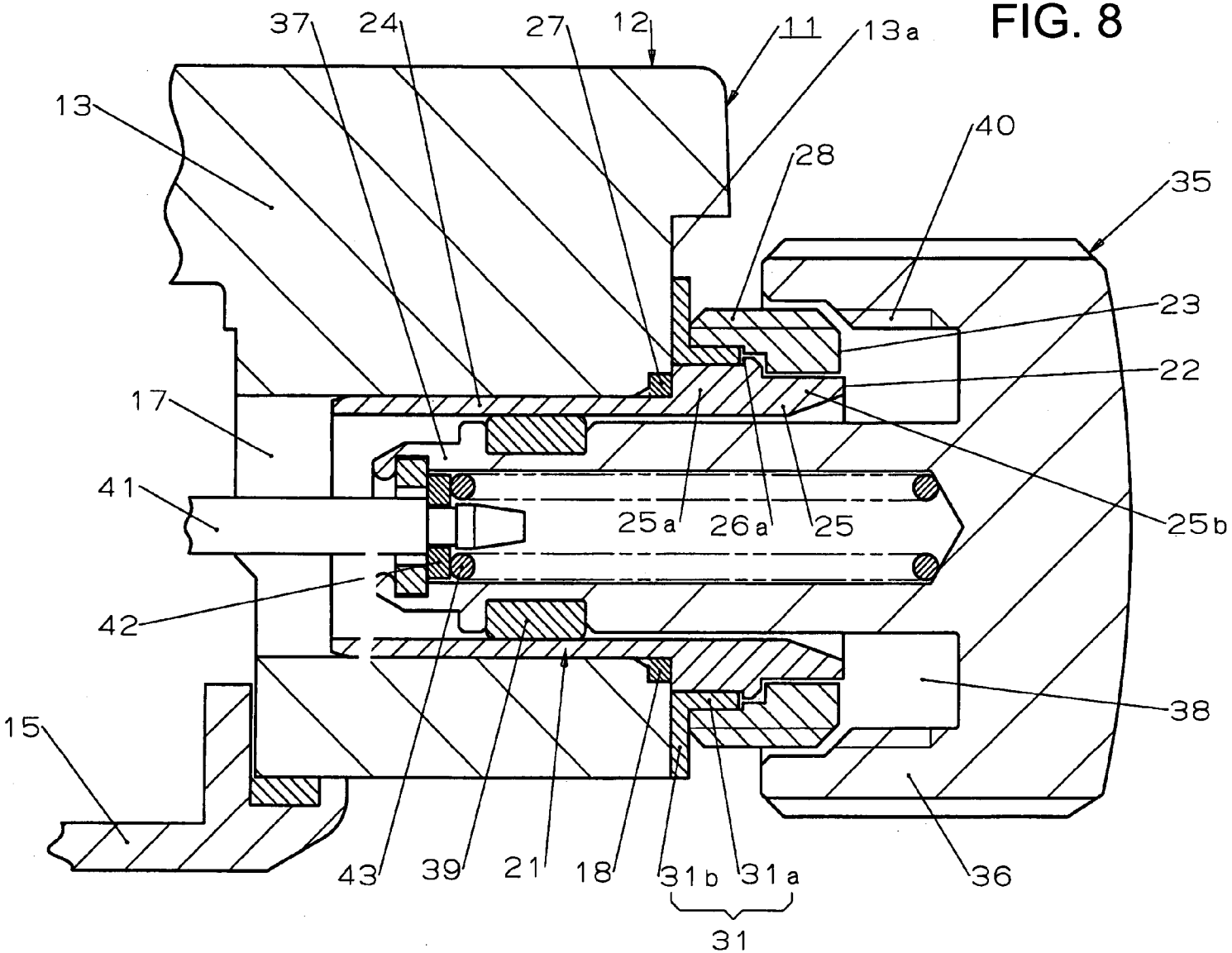
FIG. 8 is a sectional view at a surrounding of a crown showing the wristwatch according to the second embodiment in a state of screwing to lock the crown.

FIG. 7 and FIG. 8 show a second embodiment of the invention. The second embodiment is basically the same as the first embodiment and therefore, constitutions the same as those of the first embodiment are attached with notations the same as those of the first embodiment and an explanation thereof will be omitted and an explanation will be given of an item different from that of the first embodiment as follows.

According to the second embodiment, the fitting groove of the holding portion 25*a*, the fitting groove and the engaging portion of the ring 13 adopted in the first embodiment are omitted. Further, the ring holding member 31 is formed by a ring-like portion 31*a* and a flange portion 31*b* integrally expanded from an end of the ring-like portion 31*a* to an outer side. The ring-like portion 31*a* is a portion elastically deformed to be pinched between the holding portion 25*a* and the ring 23 in a compressed state. The flange portion 31*b* is a portion pinched between an end portion of the crown 35 on a side of being proximate to the case body 13 and the case body outer face 13*a* of the case body 13 when the crown 35 is screwed thereto most deeply. As a material constituting the ring holding member 31, it is preferable to adopt the material in which a friction resistance of the end face of the crown 35 exerted to the flange portion 31*b* is smaller than a friction resistance when the end face of the crown 35 is brought into contact with the case body outer face 13*a*, in other words, plastic (synthetic resin) having a sliding performance more excellent than that of the metal constituting the case body 13. Other than the item explained above is the same as that of the first embodiment including an item, not illustrated.

Therefore, the second embodiment can resolve the problem of the invention by achieving operation similar to that of the first embodiment. Further, since the ring holding member 31 includes the flange portion 31*b* pinched between the crown 35 and the case body outer face 13*a*, even when the crown 35 is strongly operated to fasten for screwing to lock the crown 35, the flange portion 31*b* is interposed between the crown 35 and the case body outer face 13*a* and the end portion of the crown 35 made of a metal is prevented from being strongly butted to bite the case body outer face 13*a* made of the metal. Therefore, in releasing screw lock for setting time or the like, an excessively large rotational force in starting to rotate the crown 35 is not needed and an operational feeling can be improved.

Figure 9:
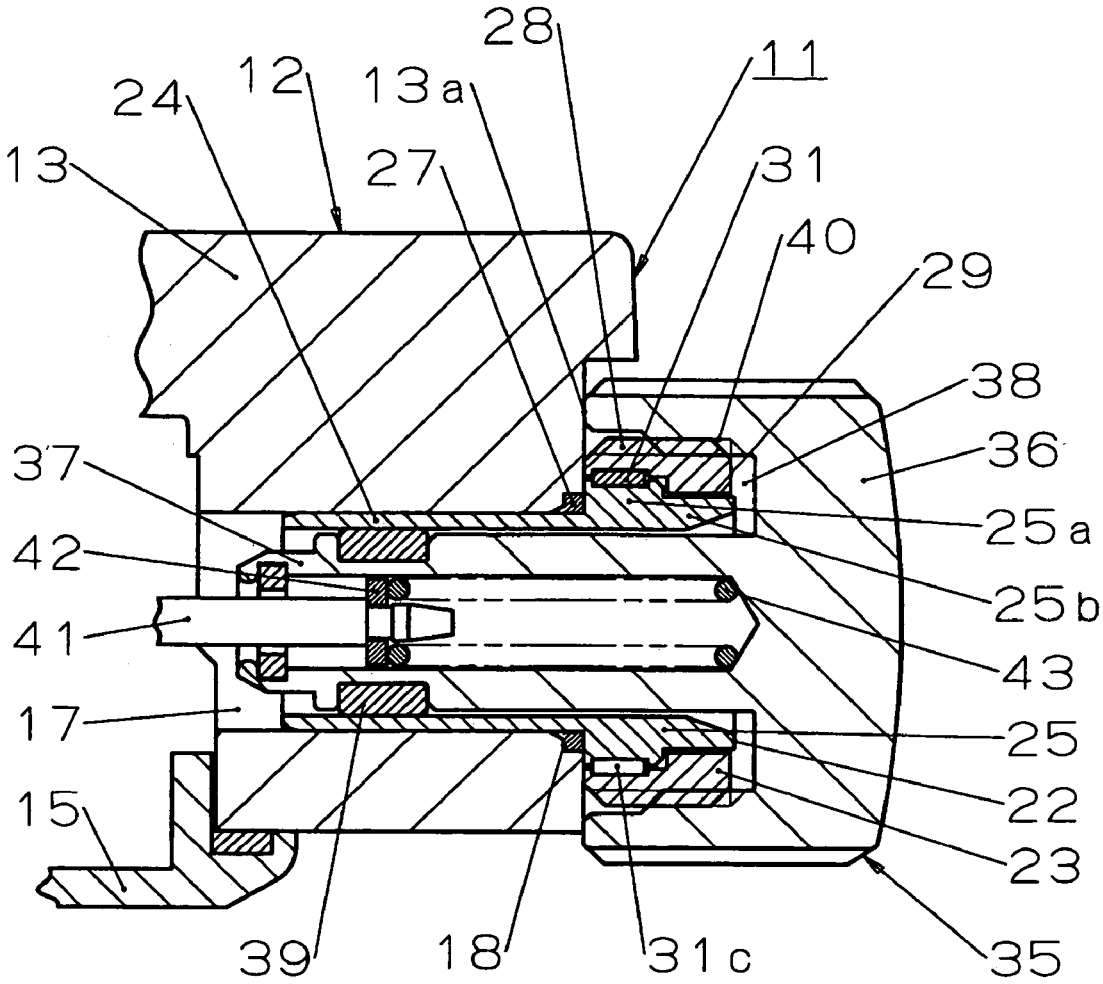
FIG. 9 is a sectional view at a surrounding of a crown showing a wristwatch according to a third embodiment of the invention in a state of screwing to lock a crown.
Figure 10:
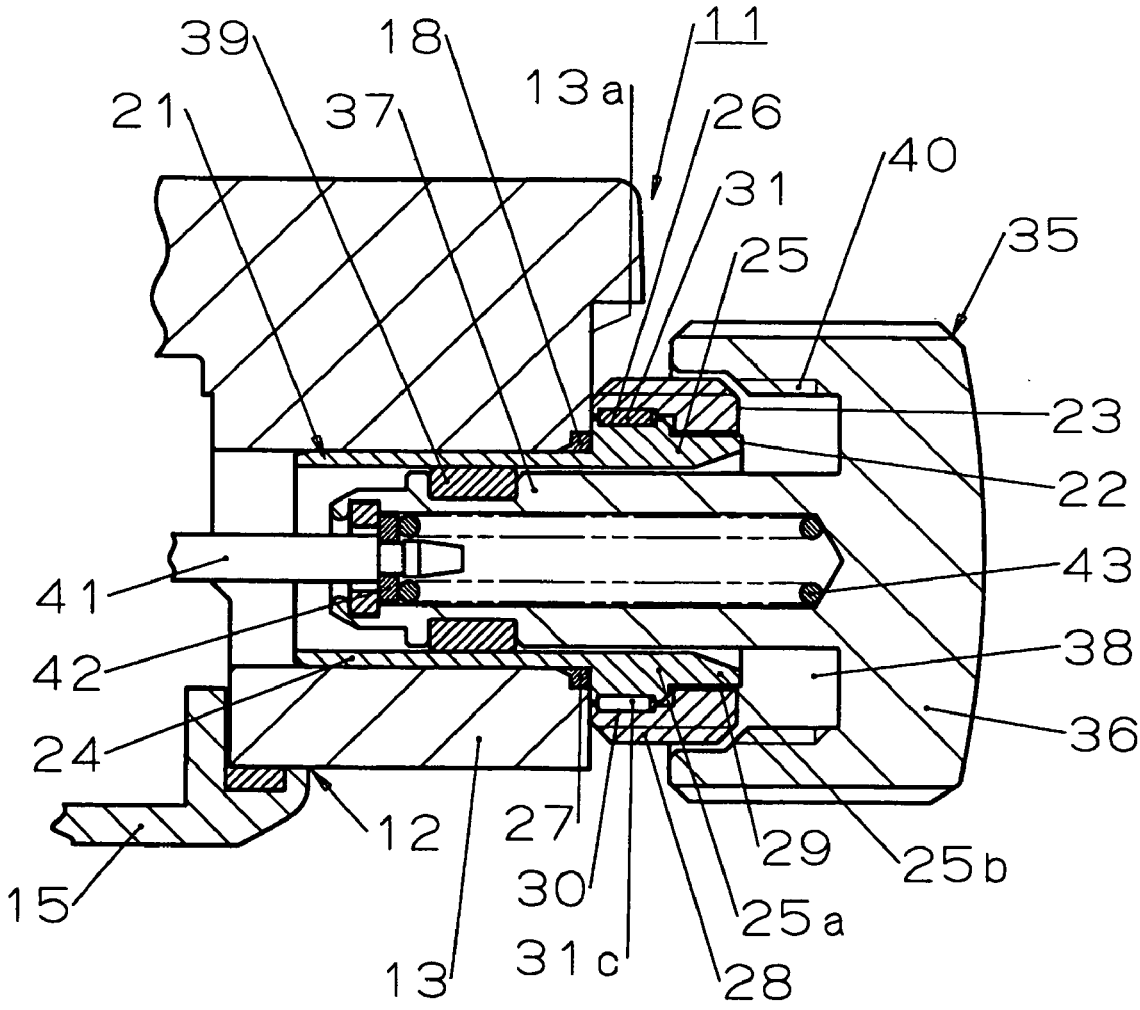
FIG. 10 is a sectional view at the surrounding of the crown showing the wristwatch according to the third embodiment in a state of releasing the crown from being screwed to lock.
Figure 11:
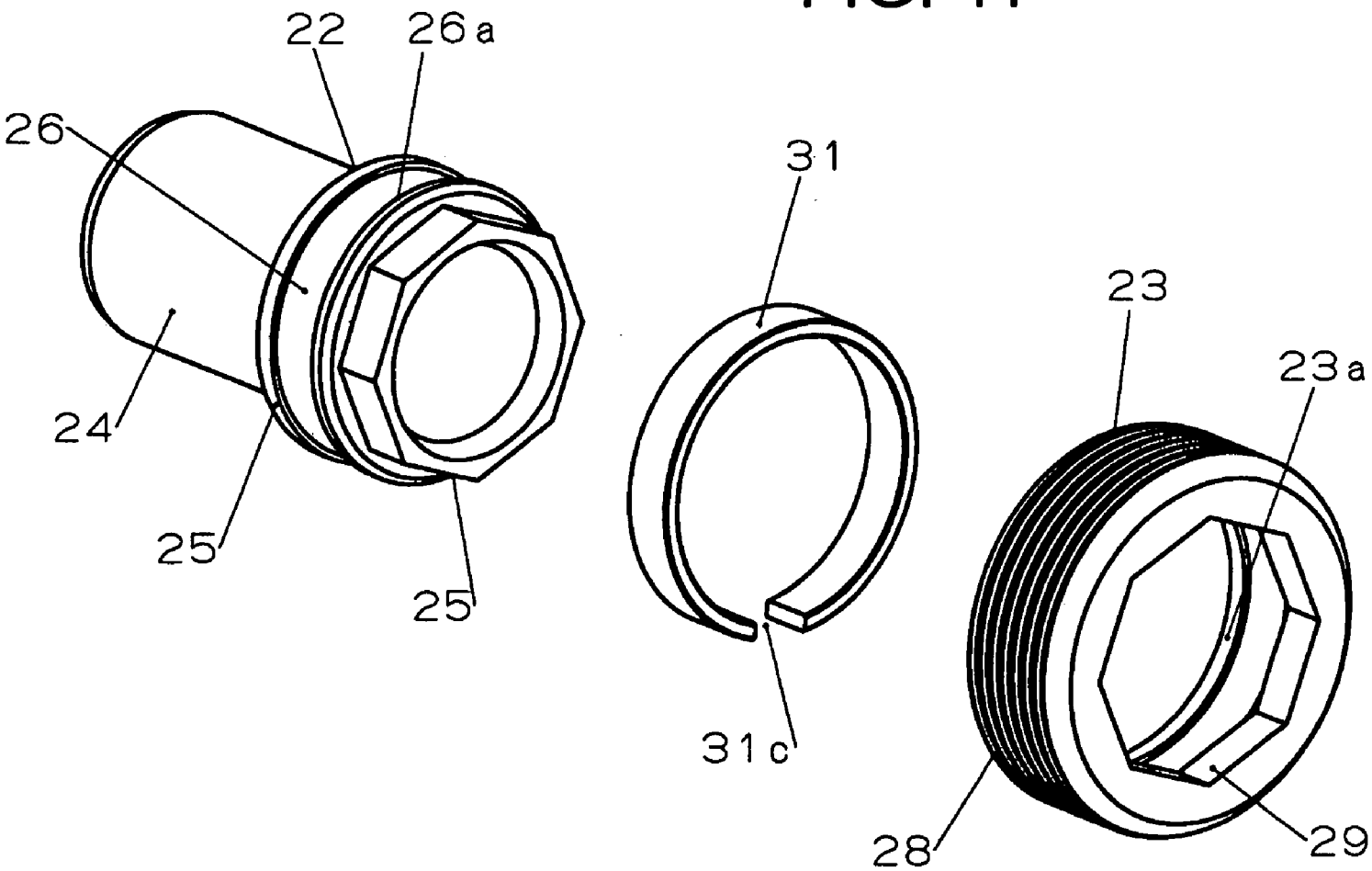
FIG. 11 is a perspective view disassembling to show a winding stem pipe provided to the wristwatch according to the third embodiment.

FIG. 9 through FIG. 11 show a third embodiment of the invention. The third embodiment is basically the same as the first embodiment and therefore, constitutions the same as those of the first embodiment are attached with notations the same as those of the first embodiment and an explanation thereof will be omitted and an explanation will be given of an item different from that of the first embodiment as follows.

According to the third embodiment, as shown by FIG. 11, the ring holding member 31 is constituted by a shape which can be regarded substantially as a ring shape by including a separated portion 31*c* for making the ring discontinuous at a portion in a peripheral direction and is made of a metal member having an elasticity, for example, spring steel.

The ring holding member 31 is easily deformed elastically to widen a diameter thereof by the separated portion 31*c* and therefore, the ring holding member 31 can easily be attached to the fitting groove 26 of the case body outside projected portion 25. Further, when the ring is fitted to the case body outside projected portion 25, the ring holding member 31 is elastically deformed in a direction of contracting the diameter within a range of a fitting clearance with the fitting groove 26 by the separated portion 31*c*. Thereby, the engaging portion 23*a* can be caught by the edge of the ring holding member 31 on the side proximate to the case body 13 by traversing the engaging portion 23*a* through the outer periphery of the ring holding member 31 comparatively easily. Further, similarly, also in the case of disengaging the case body outside projected portion 25 by prying the ring 23, the ring holding member 31 is elastically deformed in the direction of contracting the diameter and therefore, the ring 23 can easily be disengaged for interchanging the ring 23 which has been provided. Further, the ring holding member 31 is made of a metal and by catching the engaging portion 23*a* of the ring 23 by the edge of the ring holding member 31 proximate to the case body 13, the urging force of the coil spring 43 can firmly be resisted and therefore, durability of preventing the ring 23 from being disengaged from the case body out side projected portion 25 in the axial direction can be promoted.

Other than the item explained above is the same as that of the first embodiment including an item, not illustrated, and therefore, the third embodiment can resolve the problem of the invention by achieving operation similar to that of the first embodiment.

Figure 12:
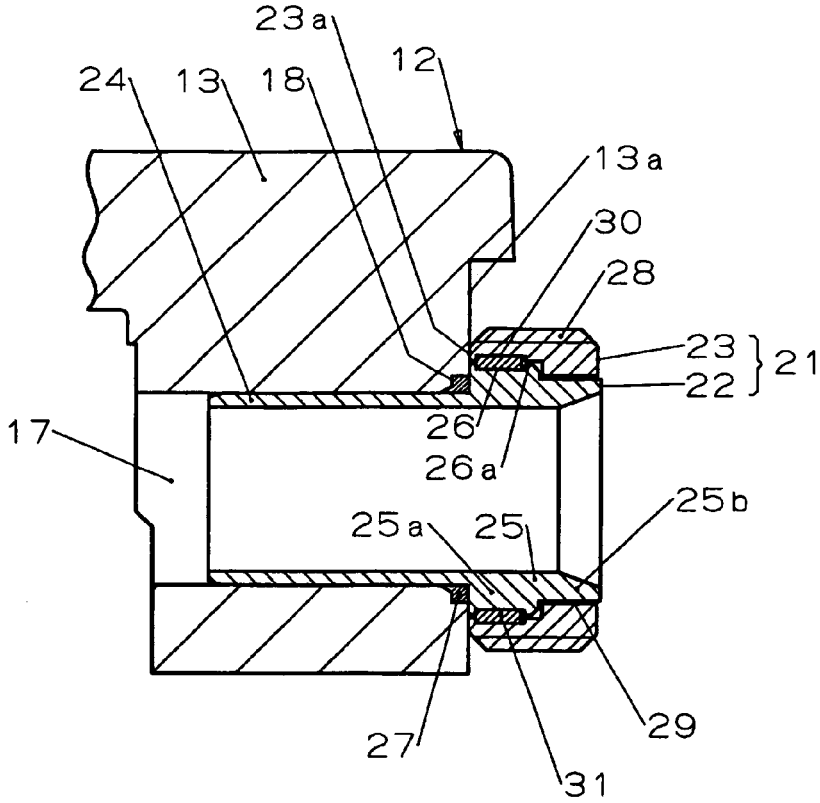
FIG. 12 is a sectional view showing a surrounding of a winding stem pipe of a wristwatch according to a fourth embodiment of the invention.
Figure 13:
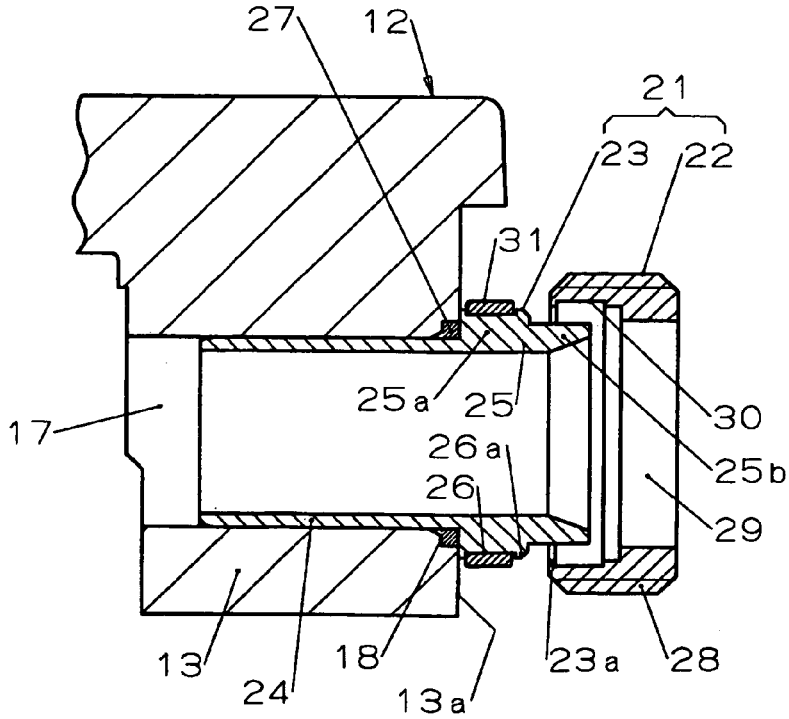
FIG. 13 is a sectional view showing the surrounding of the winding stem pipe of FIG. 12 in a state of separating a ring from a winding stem pipe main body.

FIG. 12 and FIG. 13 show a fourth embodiment of the invention. The fourth embodiment is basically the same as the first embodiment and therefore, constitutions the same as those of the first embodiment are attached with notations the same as those of the first embodiment and an explanation thereof will be omitted and an explanation will be given of an item different from that of the first embodiment as follows.

According to the fourth embodiment, the ring holding member 31 in the ring-like shape is made of a soft metal as in, for example, clay capable of being deformed plastically in accordance with an external force. The ring holding member 31 is fitted to the fitting groove 26 of the case body outside projected portion 25 and a thickness thereof is larger than a depth of the fitting groove 26.

The ring holding member 31 is plastically deformed to be filled densely in the fitting clearance with the fitting groove 26 in accordance with fitting the ring 23 to the case body outside projected portion 25. In accordance therewith, the engaging portion 23*a* of the ring 23 can be caught by the edge of the ring holding member 31 on a side of being proximate to the case body 13 by traversing the engaging portion 23*a* of the ring 23 through the outer periphery of the ring holding member 31 comparatively easily. Further, similarly, even in the case of disengaging the ring 23 from the case body outside projected portion 25 by prying the ring 23, the ring holding member 31 is plastically deformed in accordance with movement of the engaging portion 23*a* and therefore, the ring 23 which has already been provided can easily be disengaged therefrom for interchanging the ring 23. Further, the ring holding member 31 is made of a metal and by catching the engaging portion 23*a* of the ring 23 by the edge proximate to the case body 13, the urging force of the coil spring 43 can be resisted thereby. Thereby, durability for preventing the ring 23 from being disengaged from the case body outside projected portion 25 in the axial direction can be promoted.

Other than the item explained above is the same as that of the first embodiment including an item, not illustrated, and therefore, the fourth embodiment can resolve the problem of the invention by achieving operation similar to that of the first embodiment.

The invention is not restricted by the respective embodiments but applicable also to a portable timepiece of, for example, a wristwatch, a pocket watch, a hanging timepiece of a necklace type or the like which does not require the high pressure waterproof function.

According to the invention, the portable timepiece capable of interchanging parts at a surrounding of the crown when the screw lock function is deteriorated can be provided.

What is claimed is:

1. A portable timepiece comprising:

a case body having a pipe attaching hole;

a winding stem pipe arranged at an outer portion of the case body, having a case body outside projected portion formed with a holding portion and a rotation stop portion, inserted into the pipe attaching hole and fixed to the case body in a liquid tight manner;

a ring having a male screw portion formed at an outer periphery thereof and a rotation stop hole fitted to the rotation stop portion and fitted attachably and detachably to and from the case body outside projected portion;

a crown removably screwed to the male screw portion;

an urging member included in the winding stem pipe for urging the crown in a direction of being separated from the case body; and a ring holding member pinched between the holding portion and the ring for holding the ring and capable of releasing the ring from being held when an external force sufficient for releasing the holding state is exerted to the ring.

2. A portable timepiece according to claim 1, wherein the ring holding member is pinched between the holding portion and the ring in a compressed state as an elastic material.

3. A portable timepiece according to claim 1, wherein the case body outside projected portion is provided with a stepped portion for engaging with an edge of the ring holding member on a side of being remote from the case body from a side opposed to an urging direction of the urging member.

4. A portable timepiece according to claim 3, wherein an inner periphery of the ring is provided with an engaging groove fitted to an outer peripheral portion of the ring holding member and a depth of fitting the rotation stop hole to the rotation stop portion is made to be larger than a distance between an edge of the fitting groove arranged at a position the same as a position of the stepped portion in an axial direction of the case body outside projected portion on a side of being remote from the case body and the case body.

5. A portable timepiece according to claim 1, wherein an engaging portion is provided at an end portion of the ring on a side, of being proximate to the case body and the engaging portion is caught by an edge of the ring holding member on a side of being proximate to the case body.

6. A portable timepiece according to claim 2, wherein the ring holding member is formed by a ring-like portion pinched between the holding portion and the ring and a flange portion pinched between an end portion of the crown on a side of being proximate to the case body and the case body.

7. A portable timepiece according to claim 3, wherein the ring holding member is formed by a ring-like portion pinched between the holding portion and the ring and a flange portion pinched between an end portion of the crown on a side of being proximate to the case body and the case body.

* * * * *